US005796368A

United States Patent [19]

Arthur, III

[11] Patent Number: 5,796,368

[45] Date of Patent: Aug. 18, 1998

[54] RUGGED, WEATHER RESISTANT PARABOLIC DISH

[75] Inventor: John E. Arthur, III, Island Park, N.Y.

[73] Assignee: Lockleed Martin Corporation, Bethesda, Md.

[21] Appl. No.: 639,914

[22] Filed: Apr. 23, 1996

[51] Int. Cl.[6] ..... H01Q 1/02

[52] U.S. Cl. ..... 343/704; 343/912

[58] Field of Search ..... 343/703, 704, 343/840, 912

[56] References Cited

U.S. PATENT DOCUMENTS

| | | | |
|---|---|---|---|
| 2,679,003 | 5/1954 | Dyke et al. | 343/704 |
| 2,679,004 | 5/1954 | Dyke et al. | 343/704 |
| 3,618,111 | 11/1971 | Vaughan | 343/840 |
| 4,259,671 | 3/1981 | Levin | 343/704 |
| 4,866,452 | 9/1989 | Barma et al. | 343/704 |
| 4,888,596 | 12/1989 | Conanan | 343/704 X |
| 5,010,350 | 4/1991 | Lipkin et al. | 343/704 |

FOREIGN PATENT DOCUMENTS

| | | | |
|---|---|---|---|
| 60-14506 | 1/1985 | Japan | 343/840 |

*Primary Examiner*—Donald T. Hajec
*Assistant Examiner*—Tho Phan
*Attorney, Agent, or Firm*—Seymour Levine; Stanton D. Weinstein

[57] ABSTRACT

A wave reflecting dish is constructed to provide a one piece unit having a hollow, watertight region between a first external surface having a paraboloidal contour and a second external surface which includes a base. Heater elements are positioned in the hollow region on a surface opposite the first external surface. Insulating material cover the heater elements and the hollow region is filled with a foam material. Snow, ice, and water drainage from the first surface is provided through a hole which extends through the unit from the first surface to the second surface. Provisions for mounting wave emitting and receiving apparatus are provided within the first surface. Attachment pads for mounting the dish on an external structure are provided on the base.

10 Claims, 7 Drawing Sheets

FIG. 4.
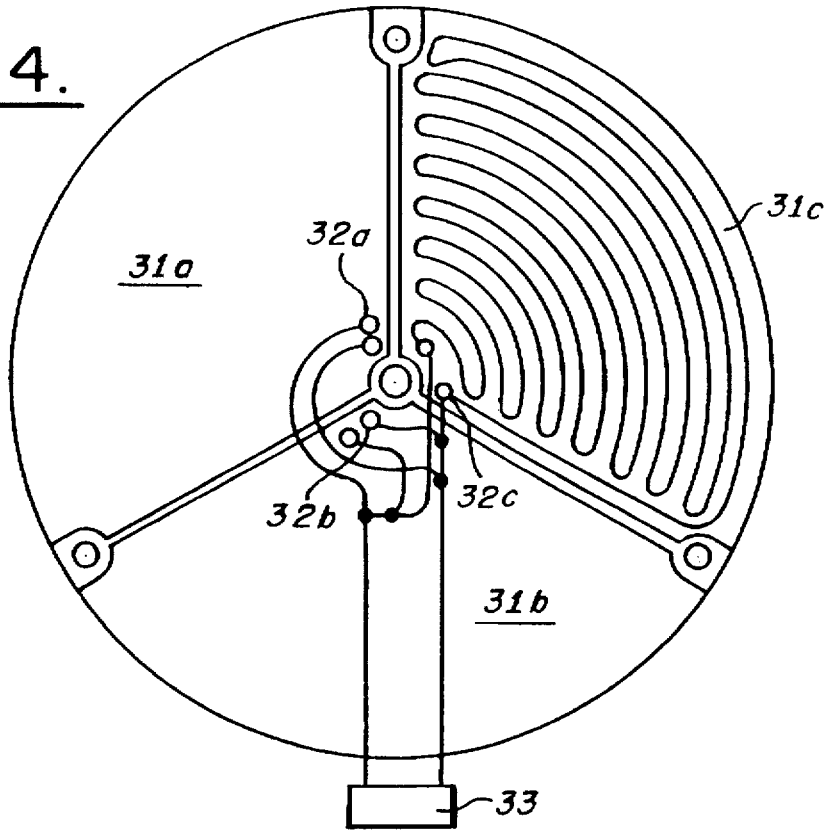
FIG. 10A.
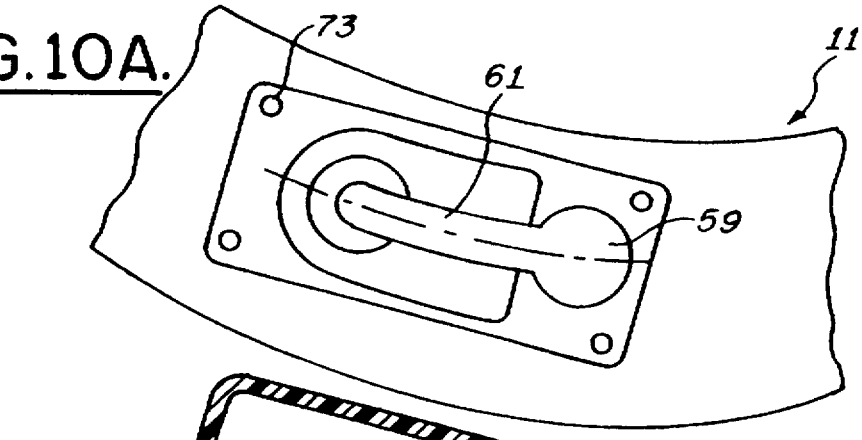
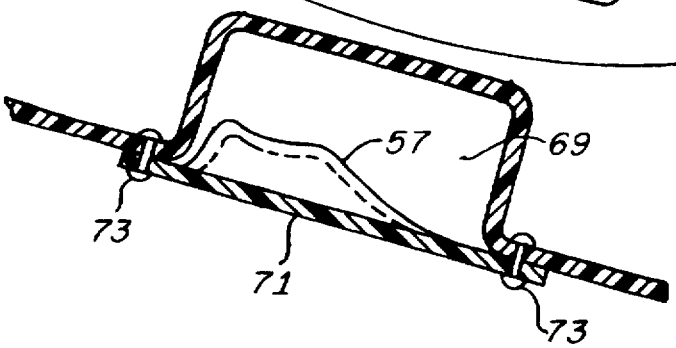
FIG. 10B.

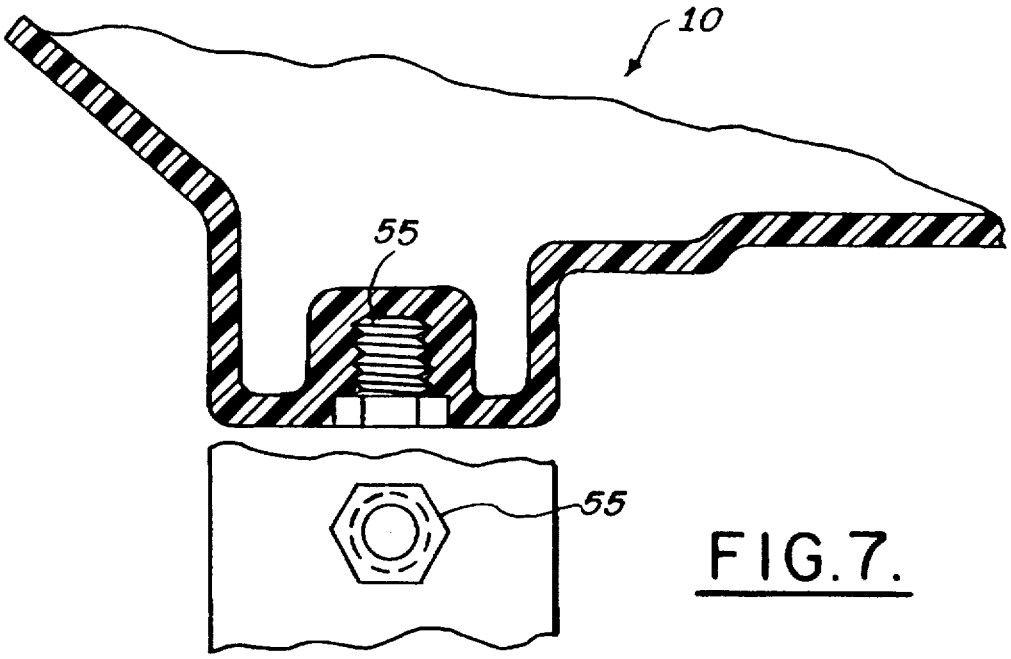
FIG.7.
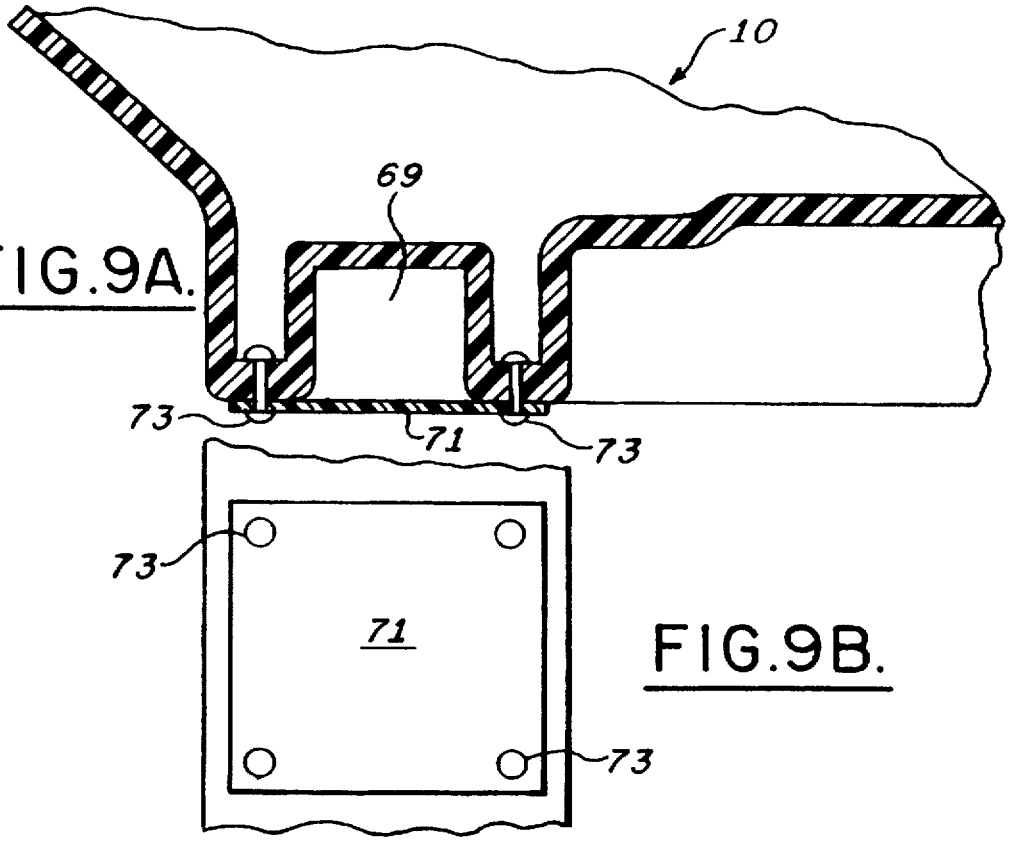
FIG.9A.
FIG.9B.

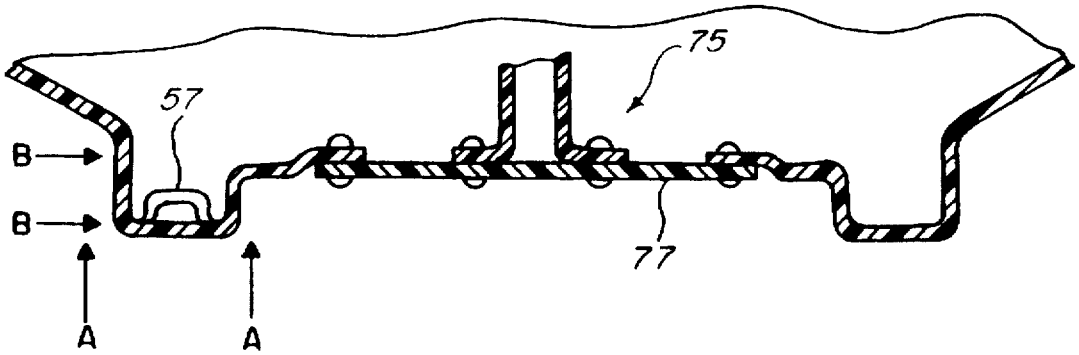
FIG.8.
FIG.8A.
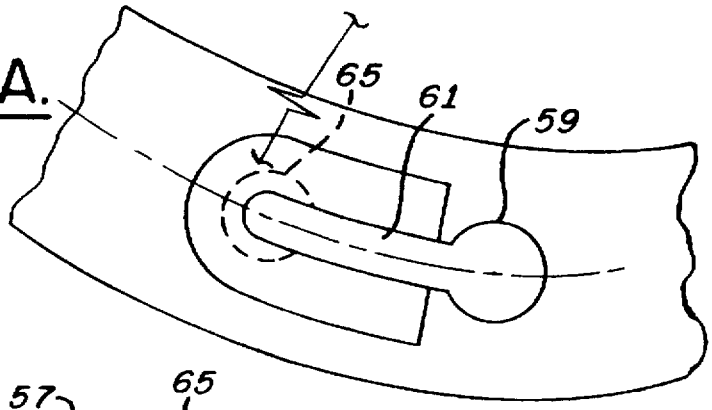
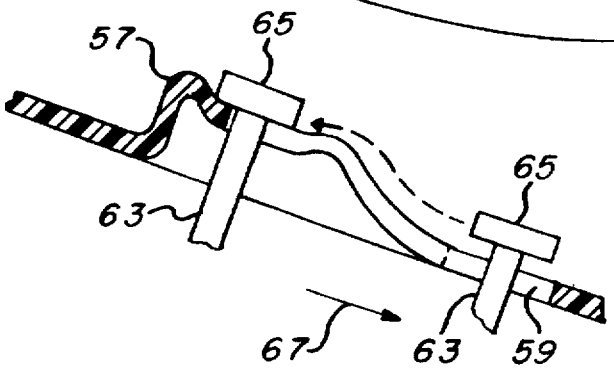
FIG.8B.

RUGGED, WEATHER RESISTANT PARABOLIC DISH

BACKGROUND OF THE INVENTION

1. Field of the Invention

The invention relates to the field of reflector type antennas and acoustic radiators, and more particularly to a parabolic reflecting dish for such antennas and acoustic radiators.

2. Description of the Prior Art

Reflector type RF antennas and acoustic radiators utilize a parabolic reflecting surface to convert a divergent wave emanating from a RF sub-antenna or acoustic element, having a center of radiation positioned at the focal point of the reflecting surface, to a radiating plane wave. Additionally, a plane wave incident to the reflecting surface is focused to the sub-antenna or acoustic element wherefrom the incident signals are directed to a receiver. Generally the sub-antenna or acoustic radiator is supported at the apex of a tripod, the legs of which are attached to the parabolic reflecting surface. To provide maximum radiation and receiving efficiency, the surface contour of the reflecting surface must be maintained to within relative tight tolerances. Since snow and ice formations on the reflecting surface seriously degrade the efficiency of the antenna, provision must be made for removing snow and ice from the reflecting surface if the antenna is to be used when weather conditions provide snow and ice.

Reflecting type acoustic antennas of the prior art are generally constructed of fiberglass. Lay-up techniques on a paraboloidal shaped wooden mold are utilized for the manufacture of such radiators. De-icing capability is provided by positioning a heating wire below the reflecting surface. This heating wire is held in place with additional fiberglass. Additional shaping and lay-up is required for structural and electrical interfaces and other design features, such as mounting pods for the tripod connection on the paraboloidal surface, mounting pods for mounting the dish on a pedestal, and provisions for coupling electrical power to the heater coil. While mold costs are initially low, the process is extremely labor intensive and overall mold dwell time, due to the setting time required between layers of fiberglass, is long. Further, fiberglass resins are expensive, thus contributing to the relatively high cost of the acoustic antenna.

Other manufacturing techniques such as injection or compression molding may be utilized to provide the desired acoustic antenna with a paraboloidal surface. Tooling costs, which increase sharply with size, for injection molding are prohibitively high. Therefore, injection molding for the manufacture of parabolic acoustic antennas is considered only for small dishes.

In addition to the high cost, fiberglass construction provides a heavy antenna. This weight leads to increased shipping costs, thereby exacerbating the cost of the antenna, and causes handling difficulties. Further, fiberglass constructed parabolic dishes are prone to chipping and cracking during handling, and subject to water penetration. This water penetration and exposure to the ultra-violet rays of the sun rapidly degrades the antenna, thus limiting its life.

Snow and ice removal from the parabolic surface present difficult problems when the aperture of the antenna is positioned horizontally for vertical sound radiation and reception. Some prior art designs have ignored the problem (fair-weather operation only), while others have attempted to melt and drain the snow and ice with built in heating wires, as above described. It has been demonstrated that snow and ice melt locally, i.e. only in the region in which the heat is applied. This local melting causes regions of unmelted snow which subsequently turns to ice due to water run-off from regions of melted snow or ice. Increasing the electrical power applied to the heating coils to increase the area of the heated regions, while providing increased melting, causes the fiberglass to burn in the immediate vicinity of the heating coils.

SUMMARY OF THE INVENTION

The deficiencies of the prior art are overcome in the present invention by providing a one piece unit constructed of high density polyethylene (HDPE) or other suitable thermoplastic resins. The thermoplastic resin is rotationally molded to create a parabolic surface with a ribbed backing for structural integrity. Further structural integrity may be provided by a hollow region between the parabolic surface and the rear of the dish and filling this region with a plastic foam such as polyurethane. Mounting points at which threaded ends of tripod legs may extend for mounting the tripod support to the antenna are provided, as are quick attachment pads for mounting the antenna on a pedestal. The rear of the parabolic surface is divided into a plurality of sections, which may be three, in each of which a heating foil is attached by positioning the foil and adding a foam-in-place filler over the foils. An electrical connector or conduit interface, for providing power to the foils, is provided at the base of the one piece molded reflector unit. A drainage hole, extending through the antenna, for snow, ice and water removal from the parabolic surface is provided at the base of the parabolic surface.

BRIEF DESCRIPTION OF THE DRAWINGS

The invention and its advantages may best be understood by reference to the following description taken in conjunction with the accompanying drawings in which like reference numerals identify like elements, and in which:

FIG. 4 is a diagram of heater coil positioning in the parabolic reflector antenna.

FIGS. 7 is a partial section view of a base for the parabolic reflector antenna.

FIG. 8 is a sectional view of a base for the parabolic reflector antenna.

FIGS. 8A and 8B illustrate are views of a support structure attachment detent in the base of the parabolic reflector antenna.

FIG. 9 is a cross-sectional view of a base having a cavity into which an attachment detent my be inserted.

FIGS. 10A and 10B are views of an attachment detent for insertion into the cavity of FIG. 9.

DESCRIPTION OF THE PREFERRED EMBODIMENTS

Figure 1:
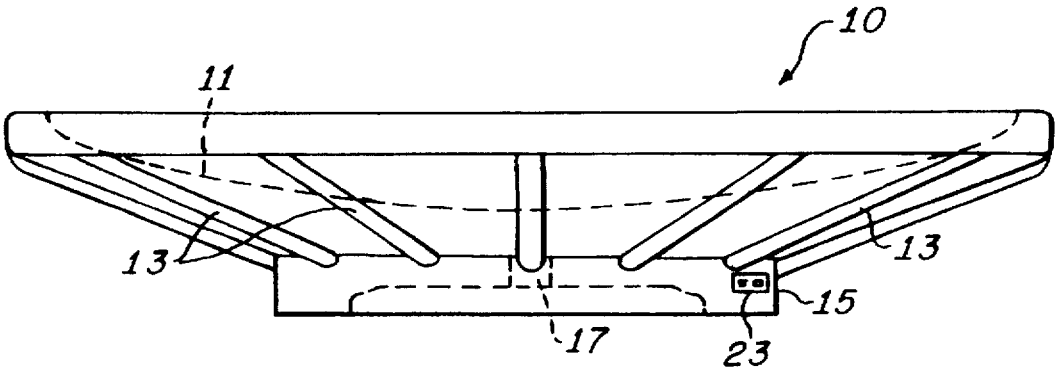
FIG. 1 is a side view of a parabolic reflector antenna construction in accordance with the invention.
Figure 2:
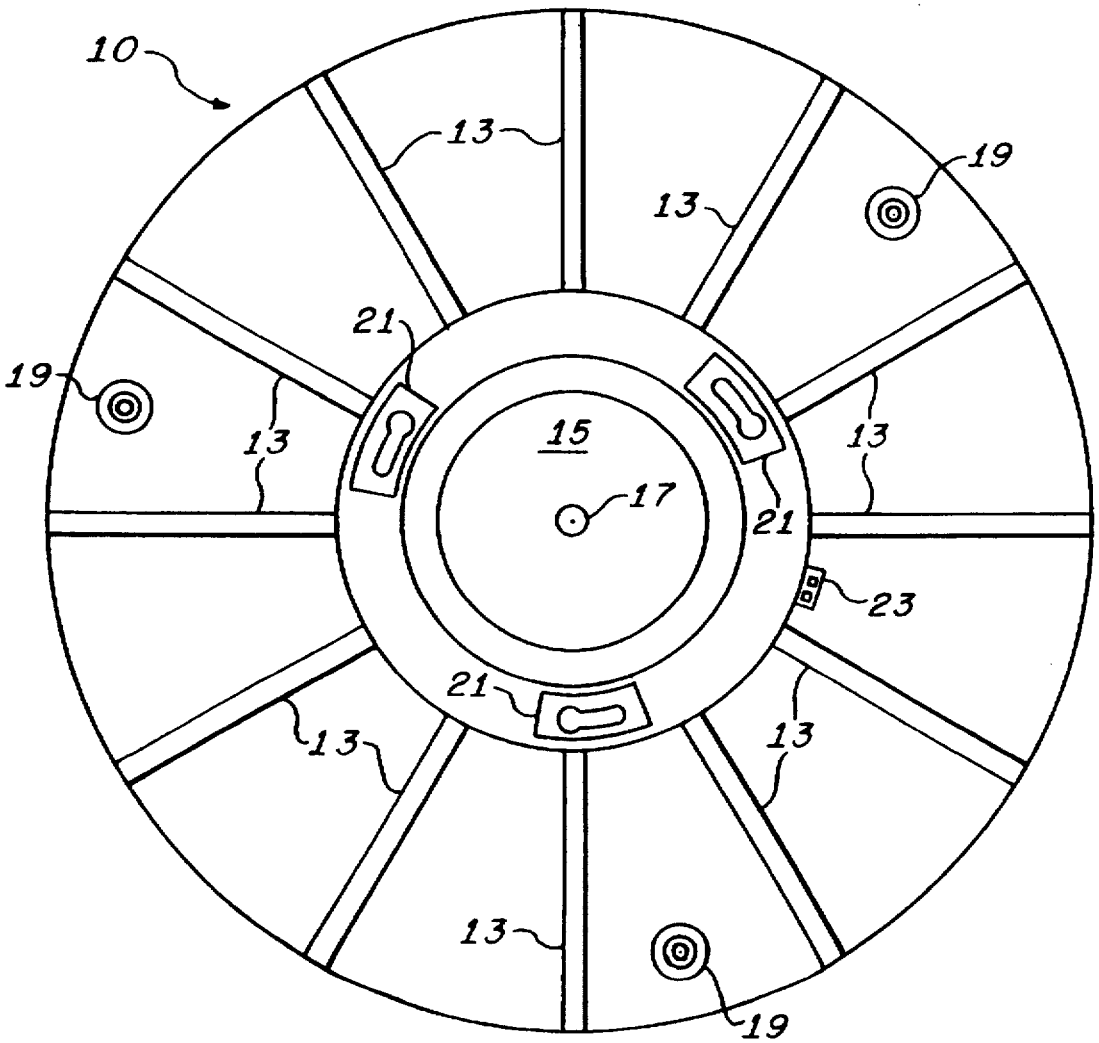
FIG. 2 is a bottom view of the parabolic reflector antenna.

Refer now to FIGS. 1 and 2, wherein side and bottom views, respectively, of a parabolic reflector antenna 10 are shown. The antenna is of unit construction having a cavity with a parabolic reflecting surface 11; ribbing 13, for structural rigidity; a base 15, for mounting the antenna on a pedestal or other suitable structure; a drain hole 17, through which water, ice, and snow may be removed from the reflecting surface; and provisions 19 for mounting a tripod on the antenna. Included in the base 15 are devices 21 for attaching the antenna to a pedestal or other mounting structure and an electrical connector 23 which is coupled to heating coils or foils, not shown.

Figure 3:
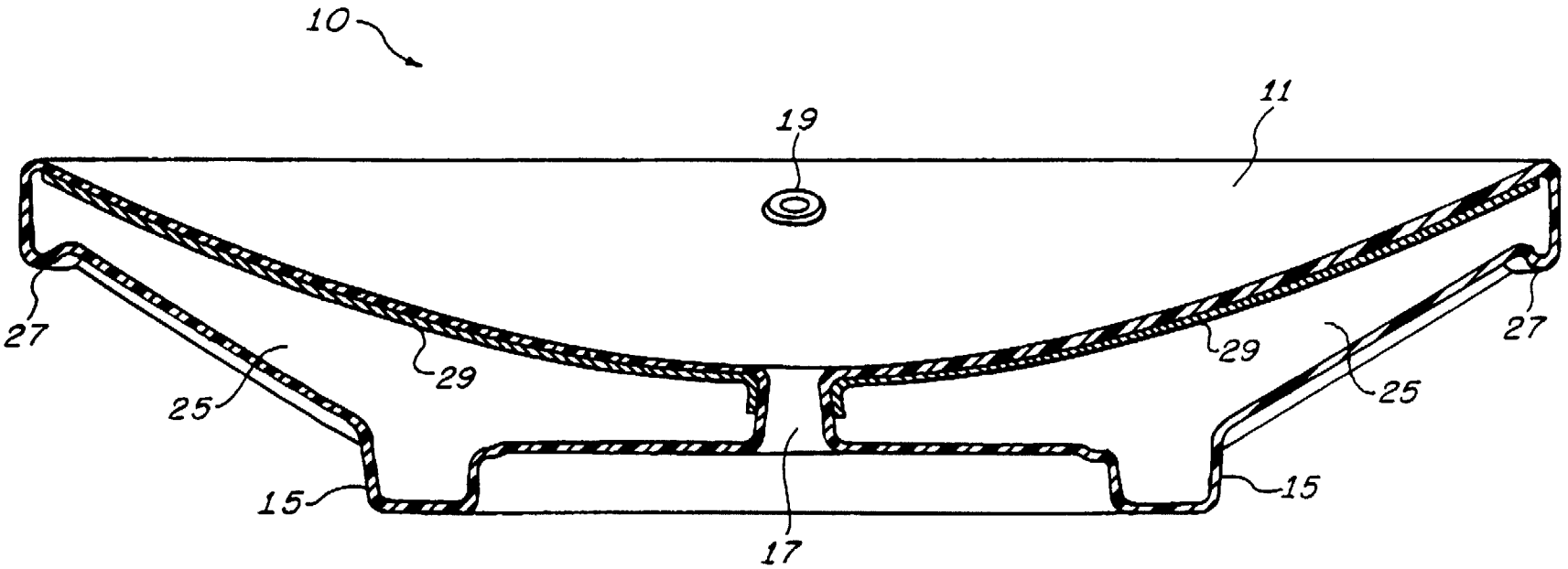
FIG. 3 is a cross-sectional view the parabolic reflector antenna of FIG. 1.

As shown FIG. 3, which is a cross-sectional view, the antenna is constructed with a hollow interior 25 contained within outer surfaces which include the parabolic reflector 11 and the base 15. These outer surfaces and the ribbing 13 are constructed of a high density material such as high density polyethylene (HDPE), or any other roto-mold grade thermoplastic. HDPE is extremely rugged and weather and ultra-violet ray resistant, thereby providing long outdoor life for the parabolic reflecting antenna. Additionally, its inherent surface lubricity, which naturally sheds snow and ice, makes it particularly suited for the parabolic surface. A lip 27, extending circumferentially around the dish, may be provided for easy handling of the unit. The interior 25 may be filled with a plastic foam, such as polyurethane. This foam material holds heating panels 29, yet to be discussed, and their associated wiring in place and provides structural rigidity.

A multiplicity of heating panels 31*a*,31*b*,31*c* are positioned on the hollow interior side of the parabolic surface, as shown in FIG. 4. Foil heating elements may be used in each heating panel. Though three panels are shown, it should be recognized that any number of panels may be utilized, including only one. An easier installation is provided, however, with the use of more than one heating panel. The terminals 32*a*, 32*b*, 32*c* of the respective panels are wired in parallel and connected to a single electrical connector 33 through which power for the panels may be applied. Thus, though power is applied through a single connector, the failure of one panel does not affect the heating power to the remaining panels. Positioning the heating panels over a large area of the parabolic surface, as shown in FIG. 4, and the use of foil heating elements, uniformly distributes relatively high heating power to the parabolic surface without local burning of the surface, thus providing uniform de-icing and elimination of ice and snow collecting zones .

Figure 5:
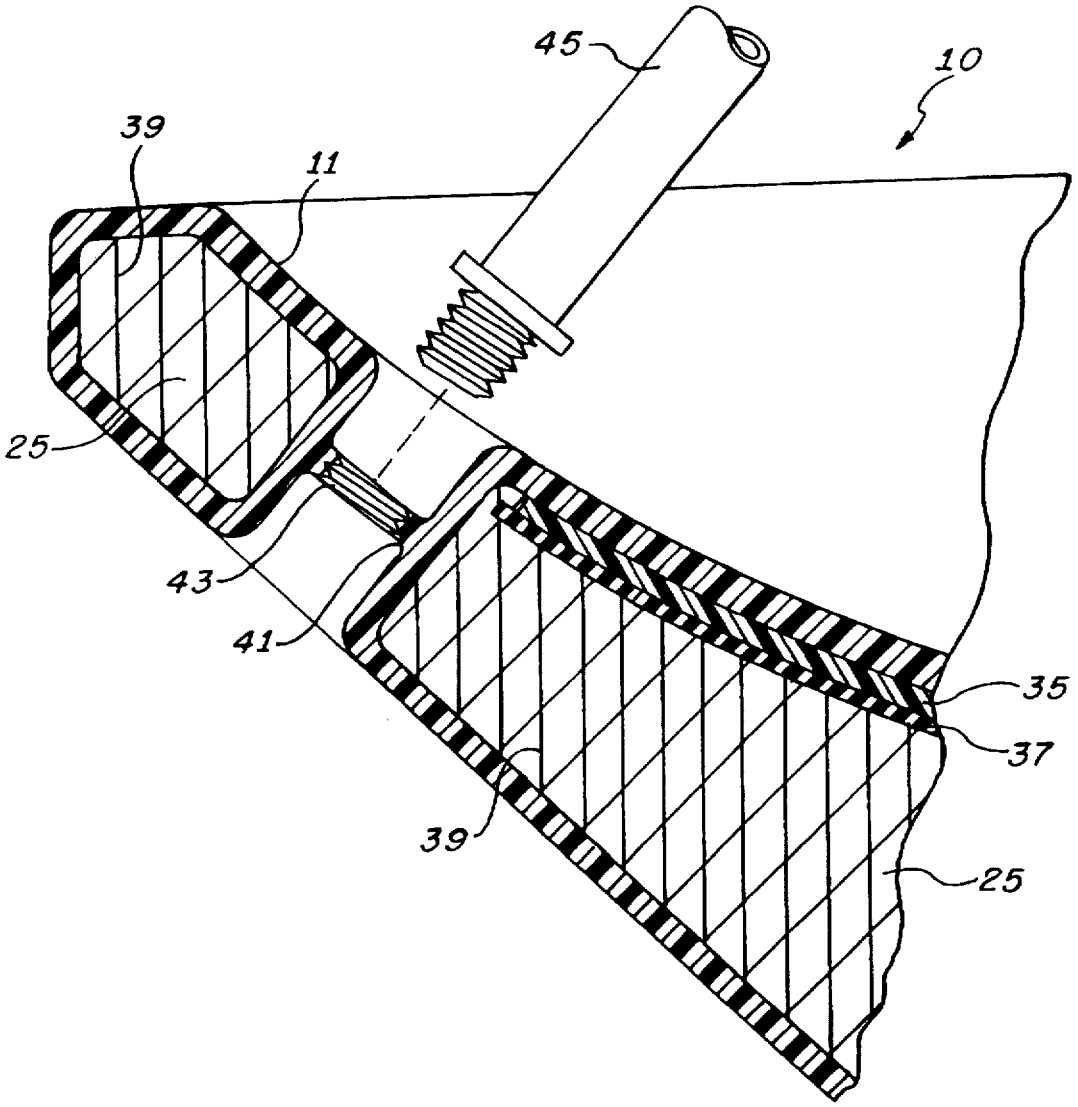
FIG. 5 is a section-edge detail of the parabolic reflector antenna indicating thereon a tripod attachment configuration.

Refer now to FIG. 5 wherein a partial cross-section of the parabolic reflector antenna is shown. Each heating panel may comprise a coil or foil heating element 35 and a thermal insulating material 37 positioned between the heating element 35 and the plastic foam 39. This insulating material provides insulation and burn protection for the foam and other portions of the hollow interior. Tripod attachment points may be provided by molding these points into the dish using an interior touch technique, as shown at 41. The interior touch adds structural rigidity and allows for the drilling of a hole 43 for the insertion of a tripod leg 45 without compromising the watertight integrity of the structure.

Figure 6:
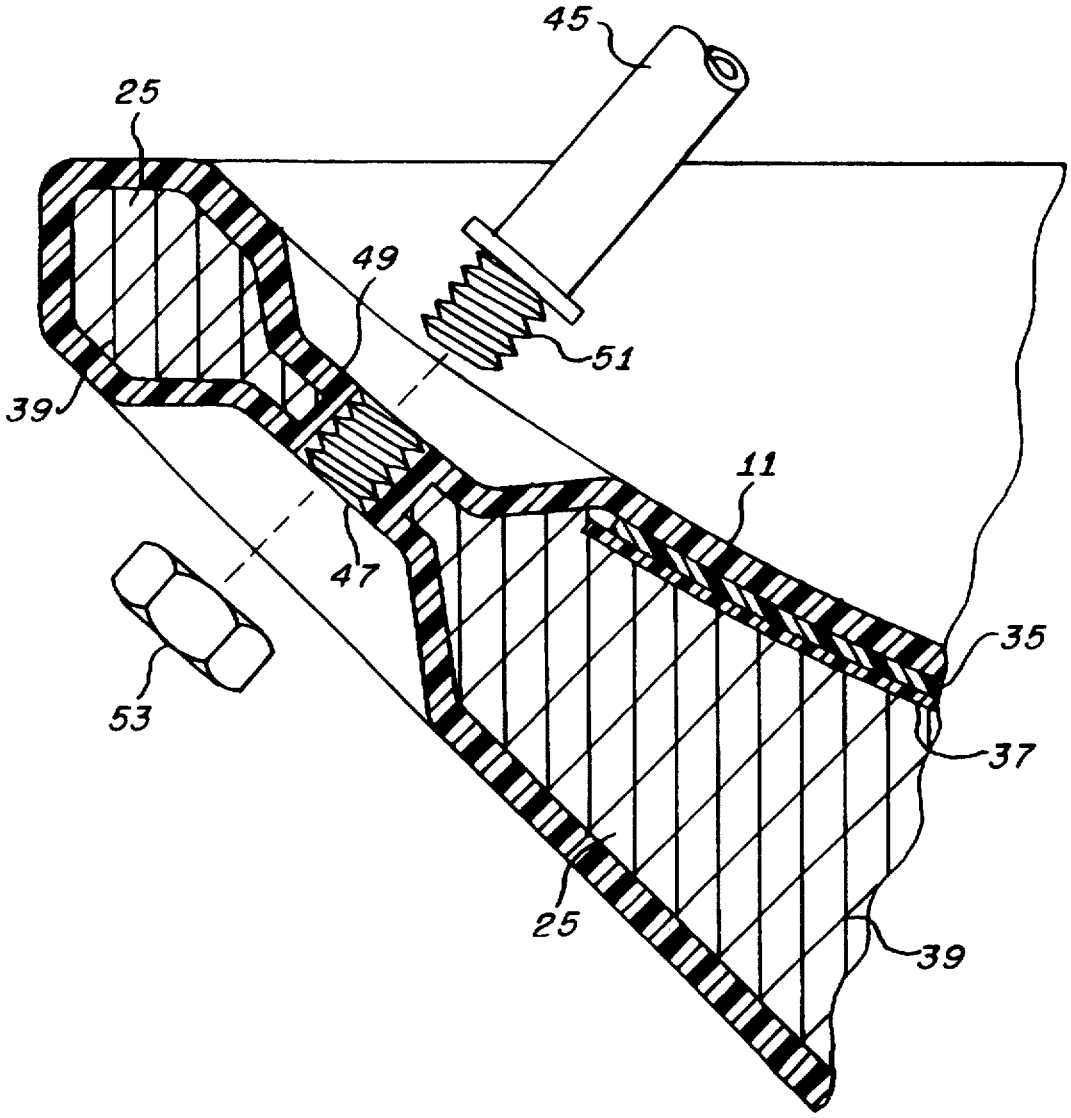
FIG. 6 is a section-edge detail of the parabolic reflector antenna indicating a second tripod attachment configuration.

A hollow design shown in FIG. 6 for tripod mounting may also be employed. This technique requires that the hole 47 be provided during the molding process in manner that maintains watertight integrity of the dish. Thus, the mold must be designed to provide the circular wall section 49 about the tripod leg insertion hole to maintain a continuous wall about the hollow interior. The tripod leg 45 is fastened to the dish by inserting a threaded section 51 thereof through the hole 47 and threading a nut 53 onto the threaded section 51.

Mounting of the parabolic reflector antenna 10 onto a pedestal or other structure may be achieved by molding threaded inserts into the base, as shown in FIG. 7. This type of mounting point requires that bolts be extended through the mounting structure into the threaded inserts and tightened. Such a procedure is time consuming and undesirable for systems in which the dish is to be mounted and removed rapidly.

Refer now to FIG. 8. A rapid attachment-detachment mechanism may comprise a detent 57, a circumferential slot 59, and an elongated grove 61 extending from the slot to the center of the detent, as shown in FIG. 8A, which is a view A—A of the detent looking upward from the base. As shown in FIG. 8B, which is a side view of the detent looking from the side of the base, the parabolic reflecting antenna is attached to the mounting structure by positioning the circumferential slot 59 over a mounting clamp, which may comprise a post 63 and cap 65 attached to the mounting structure, and rotating the parabolic reflecting antenna in the direction shown by the arrow 67. This rotation causes the detent to slide under the cap 65 causing the spring action of the detent to hold the parabolic reflecting antenna securely to the mounting structure.

The detent 57, slot 59, and grove 61 may be provided in several ways. All three may be molded into the base, the detent may be molded into the base and the slot and grove machined into the base after the molding operation, or, as shown in FIG. 9, the base may be molded to provide a cavity 69 in foot of the base and attaching a plate 71, containing detent, slot, and grove, over the cavity with rivets 73. FIGS. 10A and 10B are side and bottom views, respectively, of the plate 71 with the attachment-detachment mechanism thereon riveted to the base.

Refer again to FIG. 8. A temporary access opening 75 may be provided in the parabolic dish 10 as a post molding secondary process. This opening is utilized for the insertion of the heating elements 35, the thermal insulation elements 37, and the foam material 39. After these elements have been positioned the access hole 75 is sealed with a plate 77 to maintain the watertight integrity of the interior of the dish.

While the invention has been described in its preferred embodiments, it is to understood that the words that have been used are words of description rather than limitation and that changes may be made within the purview of the appended claims without departing from the true scope and spirit of the invention in its broader aspects.

I claim:

1. A wave reflecting dish comprising:

a seamless one piece unit with a hollow, watertight region between first and second external surfaces, said first external surface having a paraboloidal contour, thereby providing a paraboloidal surface, said second external surface seamlessly extending from said first external surface, said second external surface including a base for said seamless one piece unit, said one piece unit having a first internal surface adjacent said first external surface and said hollow, watertight region and a second internal surface seamlessly extending from said first internal surface, said second internal surface being adjacent said second external surface and said hollow, watertight region;

drainage means within said seamless one piece unit for removing environmental matter from said first external surface;

mounting means coupled to said first external surface for attaching supports for wave radiation and receiving apparatus; and external structure attachment means coupled to said base for attaching said one piece unit to an external support structure.

2. A wave reflecting dish in accordance with claim 1, wherein said drainage means includes;

a multiplicity of heating elements, respectively positioned within predetermined angular sectors, coupled to said first internal surface, each heating element having power input terminals, said power input terminals of said heating elements being electrically coupled in parallel to electrical interface means for heater power reception; and a drainage passage extending from said first external surface through said seamless one piece unit to said second external surface for passage of environmental matter from said first external surface.

3. A wave reflecting dish in accordance with claim 2 wherein said multiplicity of heating elements comprises three foil electrical conductors respectively positioned in three angular sectors on said first internal surface.

4. A wave reflecting dish in accordance with claim 2 further including:

insulation means positioned over said heating elements for insulating said hollow, watertight region from said heating elements;

a foam material filling said hollow, watertight region between said insulation means and said second internal surface.

5. A wave reflecting dish in accordance with claim 4 wherein said foam material is polyurethane.

6. A wave reflecting dish in accordance with claim 1 wherein said first and second external surfaces of said seamless one piece unit are constructed of high density polyethylene.

7. A wave reflecting dish in accordance with claim 1 constructed and arranged to provide interior touch regions whereat said first and second internal surfaces touch and wherein said mounting means includes threaded holes extending from said first external surface through said interior touch regions to said second external surface.

8. A wave reflecting dish in accordance with claim 1 wherein said mounting means includes a multiplicity of passages extending through said seamless one piece unit, each passage having a circular wall extending from said first external surface through said second external surface in a seamless manner to maintain watertight integrity of said hollow, watertight region.

9. A wave reflecting dish in accordance with claim 1 wherein said external structure attachment means includes threaded inserts in said base.

10. A wave reflecting dish in accordance with claim 1 wherein said external structure attachment means includes at least one attachment-detachment mechanism coupled to said base having therein a circular hole, an elongated slot extending from said circular hole for a predetermined distance, and a detent positioned in alignment with said elongated slot and extending a predetermined distance from said hole, whereby said wave reflecting dish may be attached to and detached from a pedestal.

* * * * *